US011674357B2

(12) United States Patent
Hausladen et al.

(10) Patent No.: US 11,674,357 B2
(45) Date of Patent: Jun. 13, 2023

(54) DRILLING APPARATUS

(71) Applicant: Liebherr-Components Biberach GmbH, Biberach an der Riss (DE)

(72) Inventors: Norbert Hausladen, Biberach (DE); Viktor Schindler, Uttenweiler (DE)

(73) Assignee: Liebherr-Components Biberach GmbH, Biberach an der Riss (DE)

( * ) Notice: Subject to any disclaimer, the term of this patent is extended or adjusted under 35 U.S.C. 154(b) by 135 days.

(21) Appl. No.: 17/258,108

(22) PCT Filed: Jun. 27, 2019

(86) PCT No.: PCT/EP2019/067218

§ 371 (c)(1),
(2) Date: Apr. 22, 2021

(87) PCT Pub. No.: WO2020/007716

PCT Pub. Date: Jan. 9, 2020

(65) Prior Publication Data

US 2021/0324686 A1 Oct. 21, 2021

(30) Foreign Application Priority Data

Jul. 6, 2018 (DE) ..... 20 2018 103 881.8
Aug. 10, 2018 (DE) ..... 20 2018 104 624.1

(51) Int. Cl.
*E21B 17/07* (2006.01)
*E21B 3/02* (2006.01)

(52) U.S. Cl.
CPC ..... *E21B 17/07* (2013.01); *E21B 3/022* (2020.05)

(58) Field of Classification Search
CPC ..... E21B 17/07; E21B 3/02
See application file for complete search history.

(56) References Cited

U.S. PATENT DOCUMENTS 5,368,083 A 11/1994 Beck
5,946,977 A * 9/1999 Sato ..... B62D 1/192 403/279

(Continued)

FOREIGN PATENT DOCUMENTS

CN 103670958 A 3/2014
CN 203488681 U 3/2014

(Continued)

OTHER PUBLICATIONS

German Search Report in DE 20 2018 104 624.1 dated Feb. 18, 2019.

(Continued)

*Primary Examiner* — Taras P Bemko
(74) *Attorney, Agent, or Firm* — Troutman Pepper Hamilton Sanders LLP; Ryan A. Schneider; Korbin M. Blunck

(57) ABSTRACT

A drilling apparatus in the form of a Kelly drilling rig including a drilling tool holder for holding a drill rod, in particular a Kelly bar, which can be rotatably driven by a rotary drive via a gearbox, wherein the gearbox includes a gearbox housing with multiple gearbox elements rotatably mounted therein. At least one plastically deformable shock absorber element for absorbing shocks is provided on at least one of the gearbox elements in the gearbox housing.

19 Claims, 4 Drawing Sheets

(56) References Cited

U.S. PATENT DOCUMENTS

| | | | | |
|---|---|---|---|---|
| 8,746,101 | B2 * | 6/2014 | Hausladen | E02F 9/128 464/33 |
| 10,890,033 | B1 * | 1/2021 | Crosby | E21B 17/00 |
| 10,982,738 | B1 * | 4/2021 | Blackmon | F16H 35/10 |
| 2005/0014597 | A1 * | 1/2005 | Michaud | F16H 57/04 475/331 |
| 2020/0224728 | A1 * | 7/2020 | Gao | B62D 7/023 |
| 2021/0039708 | A1 * | 2/2021 | Jung | B62D 3/12 |
| 2022/0001834 | A1 * | 1/2022 | Kanamori | C08L 29/14 |

FOREIGN PATENT DOCUMENTS

| | | | | |
|---|---|---|---|---|
| CN | 106151303 | A | | 11/2016 |
| CN | 107399360 | A | | 11/2017 |
| CN | 107636345 | A | | 1/2018 |
| DE | 1216218 | B | | 5/1966 |
| DE | 9104293 | U1 | | 6/1991 |
| DE | 19626223 | C2 | | 1/1998 |
| DE | 102008037338 | A1 | | 2/2010 |
| DE | 202013100548 | U1 | | 4/2013 |
| DE | 102012019850 | A1 | | 4/2014 |
| DE | 102015105908 | A1 | | 10/2016 |
| KR | 20110137695 | A | * | 12/2011 |
| KR | 20110137695 | A | | 12/2011 |

OTHER PUBLICATIONS

International Search Report and Written Opinion in PCT/EP2019/067218 dated Sep. 20, 2019.

Office Action from Chinese Application No. 201980044882.2 dated Dec. 24, 2022.

* cited by examiner

DRILLING APPARATUS

CROSS-REFERENCE TO RELATED APPLICATIONS

This application is a § 371 national stage of International Application PCT/EP2019/067218, with an international filing date of 27 Jun. 2019, which International Application claims the benefit of DE Patent Application Serial Nos. 20 2018 103 881.8 filed on 6 Jul. 2018 and 20 2018 104 624.1 filed on 10 Aug. 2018, the benefit of each of the earlier filing dates hereby claimed under 35 USC § 119(a)-(d) and (f). The entire contents and substance of all applications are hereby incorporated by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

SEQUENCE LISTING

Not Applicable

STATEMENT REGARDING PRIOR DISCLOSURES BY THE INVENTOR OR A JOINT INVENTOR

Not Applicable

BACKGROUND OF THE DISCLOSURE

1. Field of the Invention

The present invention relates to a drilling apparatus, in particular in the form of a Kelly drilling rig, comprising a drilling tool holder for holding a drill rod, in particular a Kelly bar, which can be rotatably driven by a rotary drive via a gearbox, wherein the gearbox comprises a gearbox housing with multiple gearbox elements rotatably mounted therein.

2. Description of Related Art

In the case of drilling apparatuses used in special underground engineering, there are available versatile drilling processes for introducing boreholes in earthen formations. In the drilled cavity a multitude of products can be created, e.g. by filling with ready-mixed concrete a so-called cast-in-place pile is produced, or else using precast concrete and steel members, which can then be deployed as load-bearing or lining elements. These drilling processes will include, for instance, double-head drilling, drilling with a hammer grab, full displacement drilling, continuous flight auger drilling or the so-called Kelly drilling. Kelly drilling belongs to the most prevalent methods for dry rotary drilling and is suitable for almost all soil and rock conditions, the Kelly drilling being named after its drill rod, the so-called Kelly bar. Such a Kelly bar is telescopic and facilitates large drilling depths.

In Kelly drilling, drill rods are guided through a gearbox with a hollow shaft, via which the drilling speed is built up, wherein the gearbox together with the drive and the drilling tool holder can usually be moved up and down on a leader to achieve the axial feed motion of the drill rods.

During the Kelly process, the individual drill rods, the length of which can reach several meters and the weight of which can be several tons, are telescopically constructed and can be interlocked with each other, wherein the interlocking can be designed similarly to a bayonet fastening. In this respect, the drill rods are fastened at one end to a rope and are rotationally driven by the drilling gear, wherein the feed motion is achieved by moving the rotary table, on which the drive, gearbox and drilling tool holder are mounted, along the leader.

However, when the drill rods are locked, it happens from time to time that the locking mechanism does not engage, and the drill rods fall vertically onto the drilling gear from a great height and with their own weight. This causes the drilling gear to accelerate downwards. The gear elements which are not axially fastened in the gearbox, however, remain stationary due to their inert mass or inertia, which can lead to impact strains on individual gear elements. For example, the motor shaft may strike the gear shaft which is stationary due to the inertial mass, which gear shaft may be, for example, the sun gear shaft if the drilling gear is a planetary gear train or comprises a planetary stage. Such impact strains frequently result in damage to the interior of the gear box, in particular to gear elements. It is a posteriori that the question arises as to whether the breakage of a gear element was caused by an inadequate transmission design, a defective component, or simply by such an excessive impact caused by a falling drill rod.

The problem outlined is not just restricted to Kelly drilling rigs but can also occur to other drilling apparatuses the drilling tool holder of which is rotatably driven by a gearbox and is exposed to impact, external strains in rough drilling operations.

A rotary table that is movable along a leader and carries a rotary drive next to a gearbox for a Kelly bar is known, for example, from the prior art document DE 20 2013 100 548 U1. Further Kelly drilling rigs are shown in the prior art documents DE 196 26 223 C2, DE 10 2012 019 850 A1, DE 10 2008 037 338 A1 and DE 10 2015 105 908 A1.

The present invention is based on the task of creating an improved drilling apparatus of the type mentioned above, which avoids disadvantages of the prior art and provides the latter in an advantageous way. In particular, the gearbox elements of the gearbox are to be better protected against impact strains and, in case such damage nevertheless occurs, to be rendered traceable as far as the reason thereof is concerned.

BRIEF SUMMARY OF THE INVENTION

According to an exemplary embodiment of the invention, a drilling apparatus, in particular Kelly drilling rig, having a drilling tool holder for holding a drill rod, in particular Kelly bar, can be rotatably driven by a rotary drive via a gearbox, wherein the gearbox comprises a gearbox housing having a plurality of gear elements rotatably mounted therein, wherein at least one plastically deformable shock absorber for absorbing impacts on at least one of the gear elements is provided in the gearbox housing.

It is proposed that gearbox elements subject to impacts shall be protected against impact loads by a gearbox internal shock absorber and that the shock absorber shall be configured in such a way that, in the event of excessive impact strains, the shock absorber undergoes a permanent deformation which makes such excessive impact strains also a posteriori recognizable. Smaller impact strains can be elastically absorbed by the shock absorber, while impact strains above a threshold value, which involve a risk of damage to the shock-absorbing gearbox elements, lead to elastic deformation of the shock absorber. According to the invention, at least one plastically deformable shock absorber element for absorbing shocks is provided on at least one of the gearbox elements in the gearbox housing.

In particular, the shock absorber can be arranged on an inertial gearbox element that is not held in a fixed position in order to absorb inertial shocks when external parts falling on the gearbox affect the shaking of the gearbox elements.

In a further development of the invention, the shock absorber may be configured to absorb impacts in the direction of the axis of rotation of the at least one gearbox element to which the shock absorber is assigned and then deform elastically when the axial impact force exceeds a predetermined threshold value. The threshold value advantageously remains below the destruction limit, preferably also below a damage limit at which the shock-absorbing gearbox element would be destroyed or damaged, so that the shock absorber already deforms elastically or permanently in the event of axial impacts without the shock-absorbing gearbox element being destroyed or damaged.

Due to the elastic deformability of the shock absorber, which produces a permanent deformation of the shock absorber in the case of impact forces above the threshold value, the gearbox manufacturer, for example, can reliably a posteriori assess whether the gearbox in question was exposed to excessive impact strains.

Advantageously, the shock absorber can be a component configured separately from normal bearing elements, which does not perform any or at least any permanent bearing functions and forms solely an additional support in the event of an impact. In particular, the shock absorber can be disposed at a distance from the gearbox element to be shock-absorbed in the un-deformed initial state. In the initial state, the shock absorber remains therefore without contact to the gearbox element to be shock-absorbed. Such a clearance between the shock absorber and the gearbox element does not adversely affect the normal transmission function thanks to the shock absorber and, in particular, does not generate any additional frictional resistance. The shock absorber only becomes active and comes into contact with the gearbox element to be shock-absorbed when the latter undergoes a displacement and/or shift and/or deformation due to a major impact strain which deviates from the normal movement of the gearbox element in non-impact-strained operation.

The shock absorber can be configured in versatile ways, wherein in an advantageous further development of the invention, the shock absorber can be configured as an at least approximately flat damper disc or as a flat damper plate, which can have an inner edge and/or outer edge that can be plastically deformed as intended. In principle, however, such a damper disc or damper plate can also deform plastically in a central annular region or even over the entire body if a corresponding impact strain is introduced into the shock absorber. Such a disc-shaped or plate-shaped arrangement of the shock absorber requires little space and adds little weight to the gearbox, which can accordingly be constructed in a space-saving and lightweight manner.

In an advantageous further embodiment of the invention, the shock absorber may be arranged coaxially with a central gear shaft and/or may extend substantially transversely to the axis of rotation of the gearbox element to be damped.

If the shock absorber is configured as a damper disc or damper plate in the manner specified hereinabove, the disc or plate diameter may be at least five times or even at least ten times greater than the disc or plate thickness in terms of the material or wall thickness of the disc body or plate body. On the one hand, such a thin or thin-walled configuration gives the damper sufficient elasticity to absorb smaller or limited impacts elastically; on the other hand, the desired plastic deformation can occur in the case of larger impacts. At the same time, the damper is lightweight and space-saving.

In particular, the shock absorber can be configured in the form of a thin steel disk. In principle, however, for the shock absorber there can also be used other materials.

In further embodiments of the invention, the shock absorber can support a gear shaft in regard to the gearbox housing during impact strains, in particular to prevent the gear shaft from hitting an motor shaft during impact strains due to the inertia of the gear shaft.

As a matter of fact, the support of the gear shaft can be done in different ways. In further embodiments of the invention, the shock absorber may be disposed between the gear shaft and a motor drive shaft fixedly connected thereto for rotation therewith and may support and absorb impacts of the gear shaft and/or motor shaft in regard to a gearbox housing and/or in regard to the motor housing or a structural member fixedly connected to the motor housing and/or gearbox housing.

In order to prevent the gear shafts and motor shafts from striking against each other, the shock absorber, in particular when configured as a damper disk or damper plate with a collar, can engage around the gear shaft and/or motor shaft and be disposed between a shaft shoulder and/or end face of the motor shaft and a shaft shoulder and/or end face of the gear shaft, so that in the event of axial displacement due to impact strains, the gear shaft and/or the motor shaft remains suspended on the collar or strikes it, as it were, and the shock absorber can develop its shock-absorbing effect.

Such a shock absorber with a collar on the gear shaft can be particularly advantageous if the gear shaft is axially slidable and non-rotatably arranged, for example by means of a hub/shaft profile connection.

There exist various advantageous arrangements for the shock absorber. For example, the shock absorber can be firmly supported on the gearbox housing and/or on the adjoining drive motor housing and/or a structural part firmly connected thereto, in particular rigidly fastened thereto, for example by detachable connecting means such as a screw connection.

As an alternative to rigid mounting of the shock absorber, however, it can also be mounted in an overhung position and/or rotate with a gear element.

In particular, the shock absorber may be attached to a rotatable gearbox element in order to rotate with this gearbox element, wherein the gearbox element need not be—but may nevertheless be—the gearbox element which is shock absorbed by the shock absorber.

If the gearbox comprises a planetary stage, for example, the shock absorber may be fastened to a planet carrier and may be disposed between a gear shaft shoulder and/or end face on the one hand and a housing shoulder and/or end face on the other, so that the shock absorber supports the gear shaft against the housing shoulder and/or end face in the event of axial impacts.

In this respect, the shock absorber in the neutral initial state can be disposed at a distance from both the gear shaft and the housing so as not to generate frictional resistance when the shock absorber rotates along with the planet carrier.

BRIEF DESCRIPTION OF THE DRAWINGS

The invention is explained in more detail below based on preferred exemplary embodiments and the corresponding drawings. The drawings show.

DETAILED DESCRIPTION OF THE INVENTION

Figure 1:
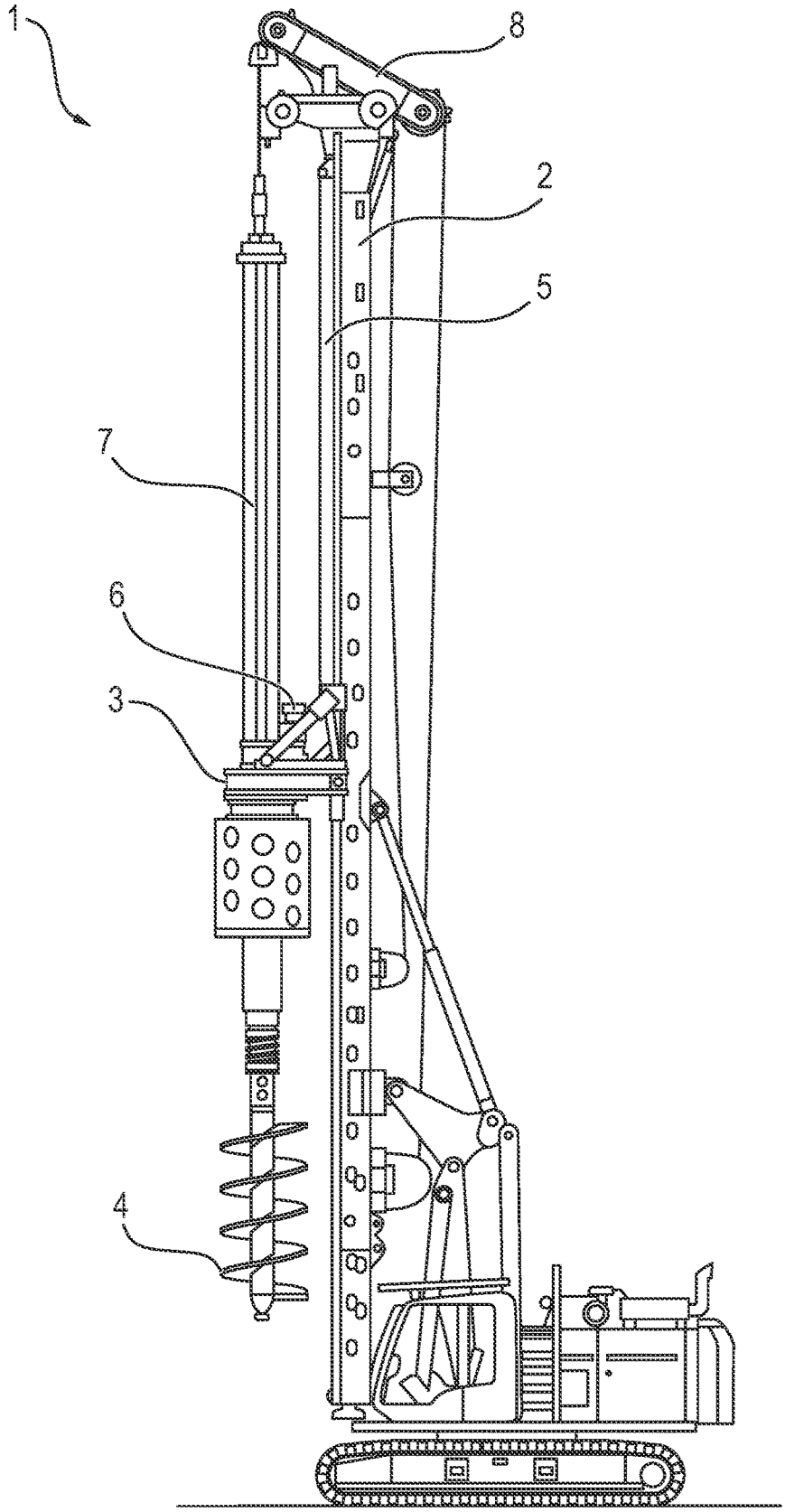
FIG. 1: a schematic overall representation of a drilling apparatus in the form of the Kelly drilling rig in accordance with an advantageous embodiment of the invention.

As FIG. 1 shows, the drilling apparatus can be in the form of a Kelly drilling rig, although it is understood that this is only an advantageous embodiment and that the drilling apparatus can also implement other drilling methods or be designed for other drilling methods.

As FIG. 1 shows, the drilling apparatus 1 can comprise a drill guide in the form of a leader 2, along which a drill carriage 3 can be moved in order to direct and impart the axial feeding of the drilling tool 4. For example, the drill guide 3 can be moved along the leader 2 by a cable drive 5, although an axial feed cylinder or other axial feed drive can also be provided.

In this case, the leader 2 can be mounted so as to tilt about a horizontal axis in order to be able to perform not only vertical but also inclined drilling, wherein, regardless thereof, the leader 2 can be disposed on the superstructure of a mobile carrier vehicle for drilling, which can be configured, for example, as a track vehicle. The superstructure can be rotated about an upright axis relative to the undercarriage.

As FIG. 1 further shows, a rotary drive 6 can be mounted on the drill carriage 3 in order to rotatably drive a drill rod 7 with a cutting or drilling tool 4 fastened thereto, so that the drilling tool movement comprises on the one hand the rotary movement generated by the rotary drive 6 and on the other hand the up and/or down movement by axial displacement of the drill carriage 3.

The drill rod 7 can be a so-called Kelly bar, which consists of several drill rod elements that can be telescopically inserted into each other or removed from each other.

The drill rod 7 can be suspended from the top 8 of the leader 2 by a rope, in particular a Kelly rope, so that it can be pulled up and lowered through the drill carriage 3.

Figure 2:
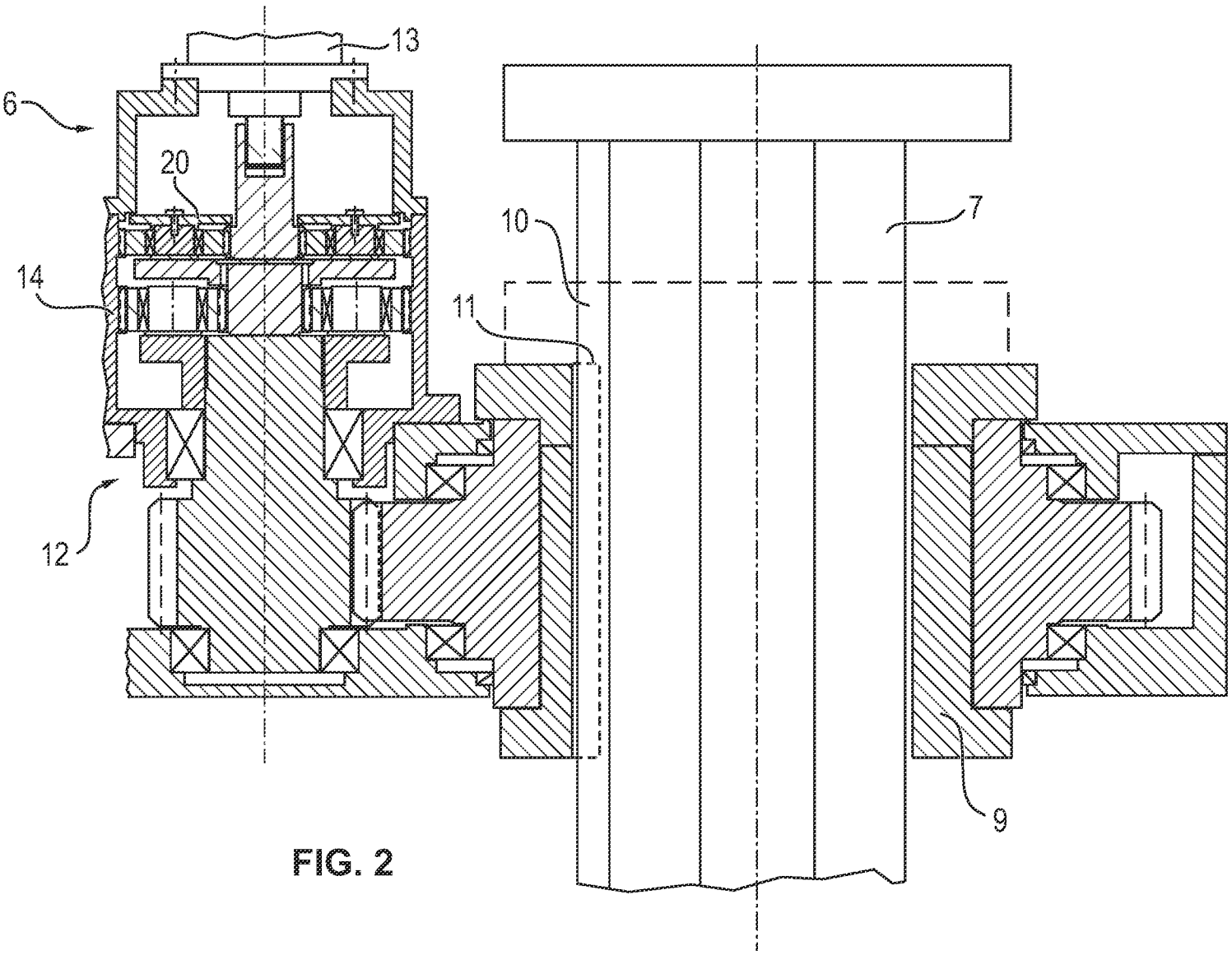
FIG. 2: a sectional view of the drilling tool holder with the drill rod that can be inserted therein and of the gear with which the drilling tool holder can be rotatably driven by a drive motor.

As FIG. 2 shows, the rotary drive 6 on the drill carriage 3 comprises a drilling tool holder 9, which can be configured as a bushing through which the drill rod 7 can be pushed in the longitudinal direction. In this regard, the drilling tool holder 9 and the drill rod 7 can each be provided with a longitudinal profiling that transmits the drilling speed and acts in a form-fitting manner in order to transmit a rotatable drive movement of the tool holder 9 to the drill rod 7. For example, the drill rod 7 can have longitudinal beads 10 in which the tool holder 9 engages with protruding longitudinal webs 11. At the same time, however, this arrangement can also be reversed, i.e. protruding longitudinal webs can be provided on the rod and longitudinal beads can be provided in the bushing-shaped holder, or also other profiles that transmit the drilling speed can be provided.

As FIG. 2 further shows, the drilling tool holder 9, which can be rotatably mounted on the drill carriage 3, can be driven via a gearbox 12, to which a drive motor 13, shown only in detail, can be coupled or connected on the input side. The drive motor 13 can for instance be a hydraulic motor or an electric motor.

As shown in FIG. 2, the gearbox 12 may comprise a gearbox housing 14 in which a plurality of gear elements are each rotatably housed, the gearbox elements advantageously each being capable of rotating around axes of rotation which may extend parallel to the longitudinal axis of the drill rod 7. Depending on the transmission design, gearbox elements with rotational axes tilted with respect thereto, for example helical gears or bevel gears, could also be provided.

However, the gearbox 12 may be configured as a planetary gear train and/or comprise at least one planetary gear stage, although a multi-stage planetary gear train may also be provided.

Figure 3:
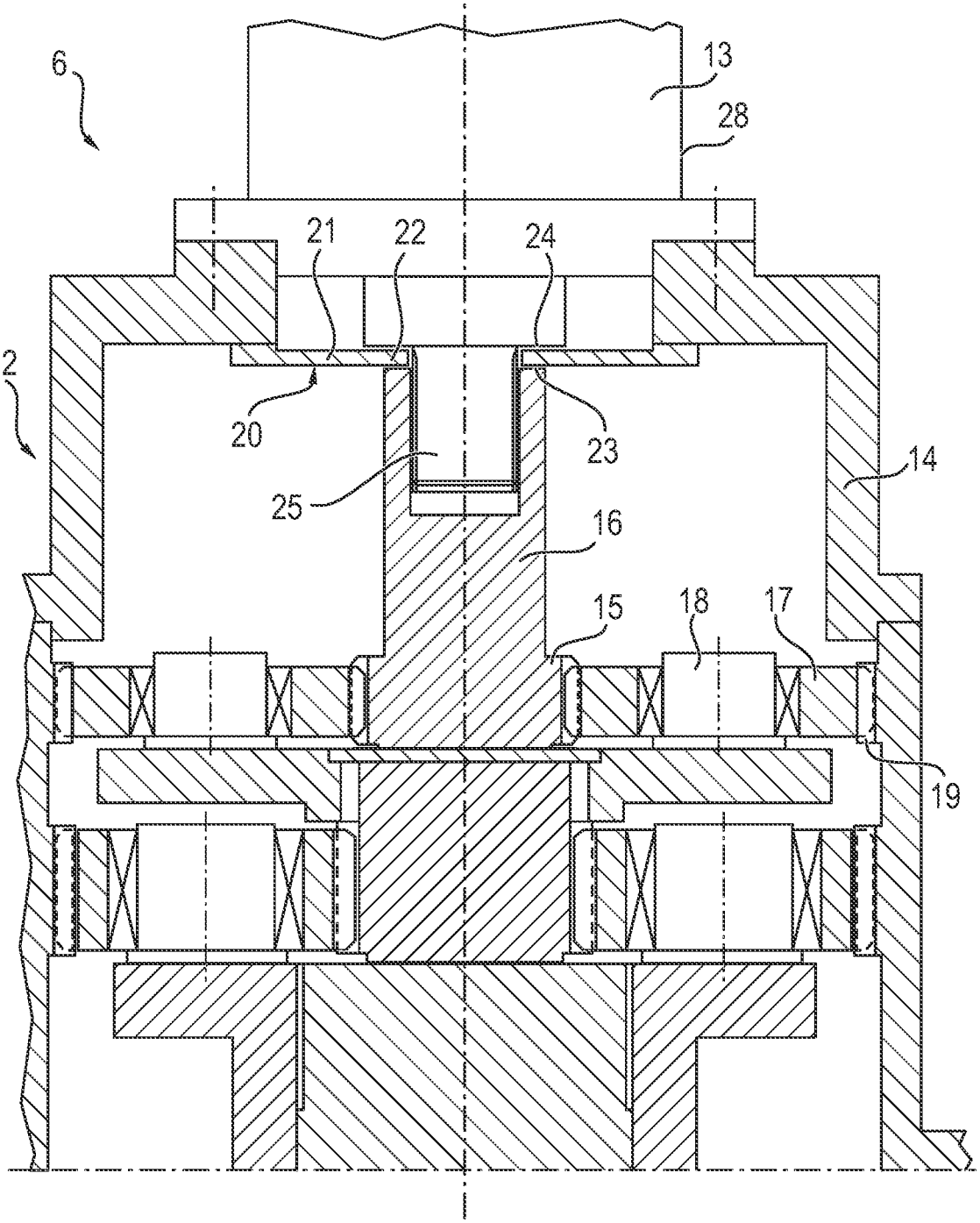
FIG. 3: a sectional cutaway view of the transmission of FIG. 2, showing a damper disc between a transmission input shaft and the motor input shaft according to an advantageous embodiment of the invention.
Figure 4:
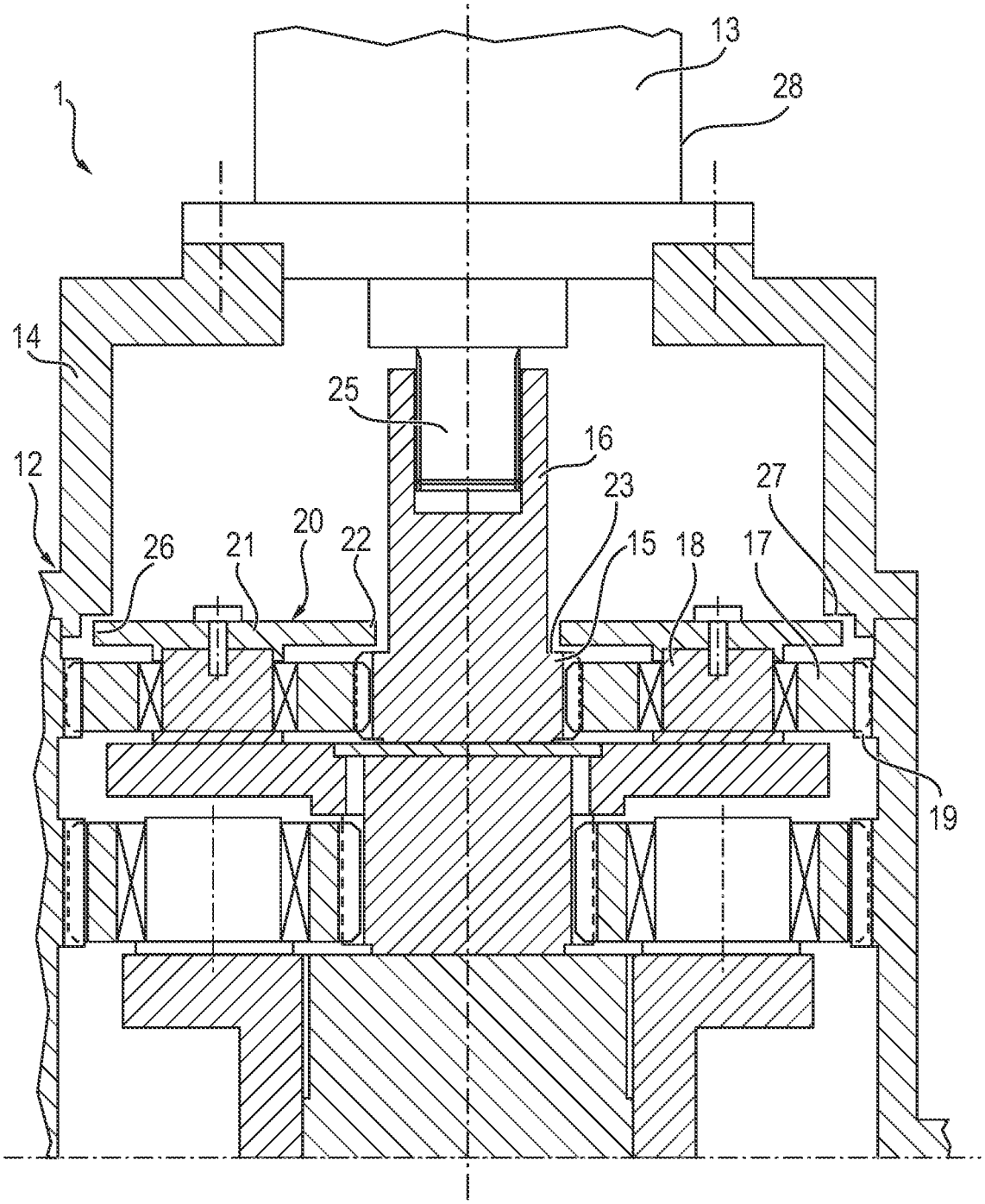
FIG. 4: a sectional cutaway view of the gearbox similar to FIG. 3, wherein a damper disc is fastened to a planet carrier of the gearbox and is disposed between a gearbox shaft shoulder and a housing shoulder.

As shown in FIGS. 3 and 4, for instance, a planetary gear stage may be provided, the sun gear 15 of which can be connected in a rotatably fixed manner to a transmission input shaft 16, which can extend parallel to the longitudinal axis of the drill rod 7. The sun gear can mesh in rolling engagement with planetary gears 17, which are rotatably mounted on a planet carrier 18 and also mesh in rolling engagement with an annular gear 19.

If the planetary gear train is of multi-stage arrangement, the planet carrier 18 can, for instance, drive another sun gear of a further planetary stage, which in turn is in rolling engagement with planetary gears rotatably mounted on a planet carrier of the second stage and in rolling engagement with an annular gear.

As FIG. 2 shows, a transmission output shaft can drive the drilling tool holder 9 for example via a spur gear stage.

However, it is understood that the interconnection of the gearbox elements may vary, and the output stage may also be configured differently. Depending on the preferred transmission ratio or reduction ratio, the annular gear could also be connected to the transmission output shaft and/or act as the transmission input shaft, in which case the sun gear could also serve as the output shaft in the latter case.

As FIG. 3 demonstrates, the transmission input shaft 16 has associated therewith a shock absorber 20 which may comprise or consist of a substantially planar damper disc 21.

The damper disc 21 can be substantially planar in shape and can be rigidly fastened, for instance bolted, to the gearbox housing 14.

The damper disc 21 thereby extends coaxially with the transmission input shaft 16 in a plane substantially perpendicular to the longitudinal axis thereof.

Notwithstanding the foregoing, the damper disc 21 may have a central recess the peripheral edge of which forms a collar 22 which extends between shaft shoulders 23 and 24 of the transmission input shaft 16 and/or overlaps the shaft shoulders 23 so that the transmission input shaft 16 would abut the collar 22 of the damper disc 21 during axial movements.

If, for example, a heavy part such as the drill rod 7 falls onto the gearbox 12 from above, this is displaced downwards, but the transmission input shaft 16, due to its mass inertia within the gearbox housing 14, moves upwards a little or stops and does not follow the downward movement of the rest of the gearbox. In itself, the transmission input shaft 16 would therefore strike axially against the motor shaft 25, but this is prevented or at least damped by the above-mentioned damper disc 21. In this case, smaller impact strains can be absorbed by the shock absorber 20, while larger impact strains lead to a plastic deformation of the collar 22 of the damper disc 21 or even to a plastic deformation of the entire damper disc 21. This makes it possible to determine a posteriori whether the gearbox has been exposed to severe impacts.

As FIG. 3 shows, the transmission input and motor shafts 16 or 25, respectively, can be connected to each other in a rotationally fixed manner by a hub/shaft profiling, for example, but still be axially displaceable with respect to each other.

As FIG. 4 shows, as an alternative to or in addition to a damper disc between the transmission input shaft 16 and the motor shaft 25, a damper disc 21 can also be provided between a transmission shaft, in particular the transmission input shaft 16 and the gearbox housing 14, in order to absorb shock loads and resulting displacements of the transmission shaft on the gearbox housing. In particular, such a damper disk 21, cf. FIG. 4, can be fastened to a co-rotating gear element, for example in the form of the planet carrier 18, for example by a screw connection, so that the damper disk 21 co-rotates with the gear element.

In this case, the damper disk 21 can cover a shaft shoulder 23 of the gear shaft 16 with an inner collar 22 and cover a housing shoulder 27 of the gearbox housing 14 with an outer collar 26, wherein the shaft shoulder 23 and the housing shoulder 27 can be positioned on opposite sides of the damper disk 21, cf. FIG. 4.

Advantageously, in its un-deformed initial state, the damper disk 21 is spaced from or disposed with clearance relative to both the shaft shoulder 23 and the housing shoulder 27, so that the damper disk 21 can rotate with the planet carrier 18 without rubbing against the transmission input shaft 16 or the housing 14.

If the gearbox 12 again encounters an axial impact strain that results in displacement of the transmission input shaft 16 within the gearbox housing 14 or relative thereto, the shaft shoulder 23 engages the damper disc 21, which then rests against the housing shoulder 27 to dampen the impact. If the impact is excessive, the damper disk 21 deforms plastically to subsequently indicate and make such an excessive impact recognizable.

In an alternative further development of the invention, such a damper disc 21 is also likely to be associated with other transmission elements, for instance the transmission output shaft and/or an intermediate transmission shaft.

If the damper disk 21 is fastened to the planet carrier 18 in the embodiment shown in FIG. 4, the damper disk 21 can not only absorb impact strains on the transmission input shaft 16, but also prevent excessive displacement of the planet carrier 18. For example, if the planet carrier 18 is displaced upward because of an impact strain, the damper disk 21 dampens this by coming into contact with the housing shoulder 27. In the case of multi-stage planetary gear trains, the lower planetary stage parts that encounter axial displacements can then also be supported at the housing shoulder 27. Reciprocally, displacements of the planet carrier 18 downward are absorbed at the shaft shoulder 23. Depending on the arrangement of the gearbox, the directions above and below may be reversed or changed accordingly.

The invention claimed is:

1. A drilling apparatus comprising:
a drilling tool holder for holding a drill rod; and
a gearbox comprising:
a gearbox housing having gear elements rotatably mounted therein; and
a shock absorber for absorbing at least one impact on at least one of the gear elements;
wherein the shock absorber is configured to:
plastically deform upon the axial impact exceeding a threshold value; and
elastically deform upon the axial impact not exceeding the threshold value;
wherein the shock absorber comprises a damper selected from the group consisting of a flat damper disc and a flat damper plate; and
wherein the damper has at least one deformable edge selected from the group consisting of an inner edge, an outer edge, and a combination thereof.

2. The drilling apparatus according to claim 1 further comprising a rotary drive for rotatably driving a drill rod;
wherein the shock absorber is further configured to:
absorb, via elastic deformation, the at least one impact in the direction of an axis of rotation of the at least one of the gear elements to which the shock absorber is assigned; and
then plastically deform if the axial impact exceeds the threshold value.

3. The drilling apparatus according to claim 1, wherein the shock absorber in an un-deformed initial state is spaced from the at least one of the gear elements to be damped.

4. The drilling apparatus according to the claim 1, wherein the damper is formed from steel; and
wherein the steel damper has an outer diameter at least five times larger than a thickness of the steel damper.

5. The drilling apparatus according to claim 1, wherein the shock absorber is disposed coaxially with the at least one of the gear elements to be damped.

6. The drilling apparatus according to claim 1, wherein the shock absorber supports a gear shaft in regard to the gearbox housing during the at least one impact.

7. The drilling apparatus according to claim 1, wherein the shock absorber is disposed between a transmission input shaft and a motor drive shaft fixedly connected thereto.

8. The drilling apparatus according to claim 7, wherein the shock absorber is fastened to the gearbox housing.

9. The drilling apparatus according to claim 7, wherein the shock absorber further supports impact strains on one or more of:
the transmission input shaft with respect to the gearbox housing;
the drive motor shaft with respect to the gearbox housing;
the transmission input shaft with respect to a motor housing; and
the drive motor shaft with respect to the motor housing.

10. The drilling apparatus according to claim 1 further comprising the drill rod;
wherein the drill rod is in the form of a telescopic Kelly bar having a plurality of drill rod parts which can be telescoped into and extended from one another.

11. The drilling apparatus according to claim 1, wherein the shock absorber is associated with either:
a gear element that is not axially fixed; or
a gear element that is fixed without clearance; and
wherein the shock absorber limits axial movements of the gear element along its axis of rotation.

12. The drilling apparatus according to claim 1, wherein the drilling apparatus is a Kelly drilling rig; and wherein the drill rod is a Kelly bar.

13. The drilling apparatus according to claim 1, wherein the shock absorber extends substantially transversely to an axis of rotation of the at least one of the gear elements to be damped.

14. A drilling apparatus comprising:

a drilling tool holder for holding a drill rod; and a gearbox comprising:

a gearbox housing having gear elements rotatably mounted therein; and a shock absorber for absorbing at least one impact on at least one of the gear elements;

wherein the shock absorber is fastened to a planet carrier and is disposed between a gear shaft element and a housing element so that the shock absorber is configured to intercept a gear shaft in the gearbox housing in the event of an axial impact; and wherein the shock absorber is further configured to:

plastically deform upon the axial impact exceeding a threshold value; and elastically deform upon the axial impact not exceeding the threshold value.

15. The drilling apparatus according to claim 14, wherein in an un-deformed initial state the shock absorber is spaced from both the gear shaft and the gearbox housing.

16. The drilling apparatus according to claim 14, wherein the gear shaft element is selected from the group consisting of a gear shaft shoulder and a gear shaft end face; and wherein the housing element is selected from the group consisting of a housing shoulder and a housing end face.

17. A drilling apparatus comprising:

a drill rod;

a drilling tool holder for holding the drill rod;

a drill carriage; and a gearbox comprising:

a gearbox housing having gear elements rotatably mounted therein; and a shock absorber for absorbing at least one impact on at least one of the gear elements;

wherein the shock absorber is configured to:

plastically deform upon the axial impact exceeding a threshold value; and elastically deform upon the axial impact not exceeding the threshold value;

wherein the gearbox is disposed on the drill carriage which is mounted in a longitudinally displaceable manner on a drill guide; and wherein the drill carriage is driven in the longitudinally displaceable manner by an axial feed drive.

18. A drilling apparatus comprising:

a drilling tool holder for holding a drill rod; and a gearbox comprising:

gear elements rotatably mounted therein; and a shock absorber having a gear engagement portion and a housing engagement portion;

wherein the shock absorber is configured to:

plastically deform upon an impact in the direction of an axis of rotation of an associated one of the rotatably mounted gear elements;

elastically deform upon an axial impact to an associated gear element not exceeding a threshold value;

rotate freely relative to the associated gear element and a housing in an initial state of the gearbox without axial impact; and transmit at least a portion of the axial impact to the housing in an impact state of the gearbox with the axial impact;

wherein the housing is selected from the group consisting of a gearbox housing and a motor housing; and wherein the shock absorber transmits at least a portion of the axial impact to the housing via axial abutment of the:

gear engagement portion of the shock absorber against the associated gear element; and housing engagement portion of the shock absorber against a portion of the housing.

19. A drilling apparatus comprising:

a drilling tool holder for holding a drill rod; and a gearbox comprising:

gear elements rotatably mounted therein; and a damper for absorbing an axial impact on an associated one of the gear elements, wherein the damper has a first side and an opposite second side, and wherein the damper has an outer edge at the first side and an inner edge at the opposite second side;

wherein the damper is configured to:

plastically deform upon the axial impact to the associated gear element exceeding a threshold value; and elastically deform upon the axial impact to the associated gear element not exceeding the threshold value;

wherein a housing shoulder is a portion of a housing selected from the group consisting of a gearbox housing and a motor housing;

wherein a gear shoulder is a portion of the associated gear element;

wherein in an initial state of the gearbox without axial impact, the damper is:

axially movable between both the housing shoulder and the gear shoulder; and spaced from both the housing shoulder and the gear shoulder; and wherein in an impact state of the gearbox with the axial impact, the damper comes into contact with both the housing shoulder and the gear shoulder, with the outer edge abutting the housing shoulder and the inner edge abutting the gear shoulder.

* * * * *